US006515629B1

(12) United States Patent
Kuo et al.

(10) Patent No.: US 6,515,629 B1
(45) Date of Patent: Feb. 4, 2003

(54) DUAL-BAND INVERTED-F ANTENNA

(75) Inventors: Yen-Liang Kuo, Tainan (TW); Tsung-Wen Chiu, Taipei (TW); Kin-Lu Wong, No. 1, Creation Rd. 3, Science-Based Industrial Park, Hsinchu (TW)

(73) Assignees: Accton Technology Corporation (TW); Kin-Lu Wong (TW)

( * ) Notice: Subject to any disclaimer, the term of this patent is extended or adjusted under 35 U.S.C. 154(b) by 0 days.

(21) Appl. No.: 09/989,281

(22) Filed: Nov. 20, 2001

(30) Foreign Application Priority Data

Oct. 3, 2001 (TW) ..... 90124455 A

(51) Int. Cl.[7] ..... H01Q 1/38
(52) U.S. Cl. ..... 343/700 MS; 343/702
(58) Field of Search ..... 343/700 MS, 702, 343/846, 848

(56) References Cited

U.S. PATENT DOCUMENTS 6,008,762 A * 12/1999 Ngheim ..... 343/700 MS
6,100,849 A * 8/2000 Tsubaki et al. ..... 343/700 MS
6,218,991 B1 * 4/2001 Sanad ..... 343/700 MS
6,268,831 B1 * 7/2001 Sanford ..... 343/700 MS
6,346,914 B1 * 2/2002 Annamaa ..... 343/700 MS

* cited by examiner

*Primary Examiner*—Tan Ho
(74) *Attorney, Agent, or Firm*—BakerBotts LLP

(57) ABSTRACT

A dual-band inverted-F antenna is disclosed. This dual-band inverted-F antenna comprises: a substrate with a first surface and a second surface; a ground plane located on the second surface of the substrate; a first radiating metal line located on the first surface of the substrate; a second radiating metal line located on the first surface of the substrate; a feeding line located on the first surface of the substrate and the feeding line connected with the middle positions of the first radiating metal line and the second radiating metal line for feeding signal; a connecting line located on the first surface of the substrate and used to connect with the first radiating metal line and the second radiating metal line at the same time; and a common shorting metal pin used to short-circuit the first radiating metal line and the second radiating metal line to the ground plane. There is a valuable implementation in industrial field because the dual-band inverted-F antenna of the present invention can be operated in two separate bands, and can be printed on a microwave substrate, which makes it easy to integrate with other associated microwave circuitry.

14 Claims, 10 Drawing Sheets

DUAL-BAND INVERTED-F ANTENNA

FIELD OF THE INVENTION

The present invention relates to a dual-band inverted-F antenna. More particularly, it relates to an inverted-F printed antenna that can be operated in two separate bands.

BACKGROUND OF THE INVENTION

To follow the advancement of the communication technology, the applications using communication technologies have been increased significantly and the related products have become more diversified. Especially, consumers have more demands for the functions of communication applications, so that there are many communication applications with different designs and functions issued continuously. For example, the products with one-piece design of dual-band or triple-band, and even the implementations of multi-band operation using one single antenna are the main streams. Moreover, by utilizing IC technologies, the size of products will become smaller in future.

Microstrip antennas or printed antennas are becoming more attractive, because they are very suitable for applications in present-day communication products. Among various types of designs, the inverted-F antenna has the attractive features of small volume, simple structure, easy design, etc., and the inverted-F antenna has been utilized popularly in various products and communication systems in recent years, especially in the products required for easy, convenient, and good receiving/transmitting capabilities.

However, a conventional inverted-F antenna only has a function of single operating frequency. If the conventional inverted-F antenna is utilized in dual-band products or multi-band products, two or more inverted-F antennas are required for the multi-band operation. Therefore, the difficulty in the design of products increases, and the size and cost of products increase accordingly.

SUMMARY OF THE INVENTION

In the view of the background of the invention described above, an antenna is an important part in wireless communications, since the performance of wireless communications is greatly affected by the antenna. Therefore, low cost, high efficiency and simple implementation are the major trends for the design of antenna. The conventional inverted-F antenna has several features, such as small volume, simple structure, easy design, etc., so that the conventional inverted-F antenna has been used widely. However, the conventional inverted-F antenna has the disadvantage that it can be operated in a single band only.

It is the principal object of the present invention to provide a dual-band inverted-F antenna. More particularly, the present invention relates to an inverted-F printed antenna that can be operated in two separate bands. More complete functions and wider operating frequency range are attained and provided, because the dual-band inverted-F antenna of the present invention can be operated both in a low frequency band and in a high frequency band. Moreover, the implementation of the present invention is valuable in industrial field, because the dual-band inverted-F antenna of the present invention can be operated in two separate bands, and can be printed on a microwave substrate, which makes it easy to integrate with other associated microwave circuitry.

In accordance with the aforementioned purpose of the present invention, the present invention provides a dual-band inverted-F antenna. The main radiating component of the dual-band inverted-F antenna of the present invention is two stacked radiating metal lines that are fed and driven by a same feeding line. According to the different lengths, widths and shapes of the two stacked radiating metal lines, the dual-band inverted-F antenna of the present invention can be operated in a low frequency band and a high frequency band, and their frequency ratio can also be adjusted easily. Moreover, since the radiating metal lines and the ground plane are printed directly on a substrate, the cost is thus lower and the manufacturing can be processed easily.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The structure of the dual-band inverted-F antenna of the present invention is simple and is different from the conventional inverted-F antenna whose shorted radiating metal patch is placed above the ground plane in a three-dimensional structure. The metal patch or metal line of the dual-band inverted-F antenna of the present invention is printed directly on a microwave substrate in a two-dimensional structure so that the implementation is more convenient.

Figure 1:
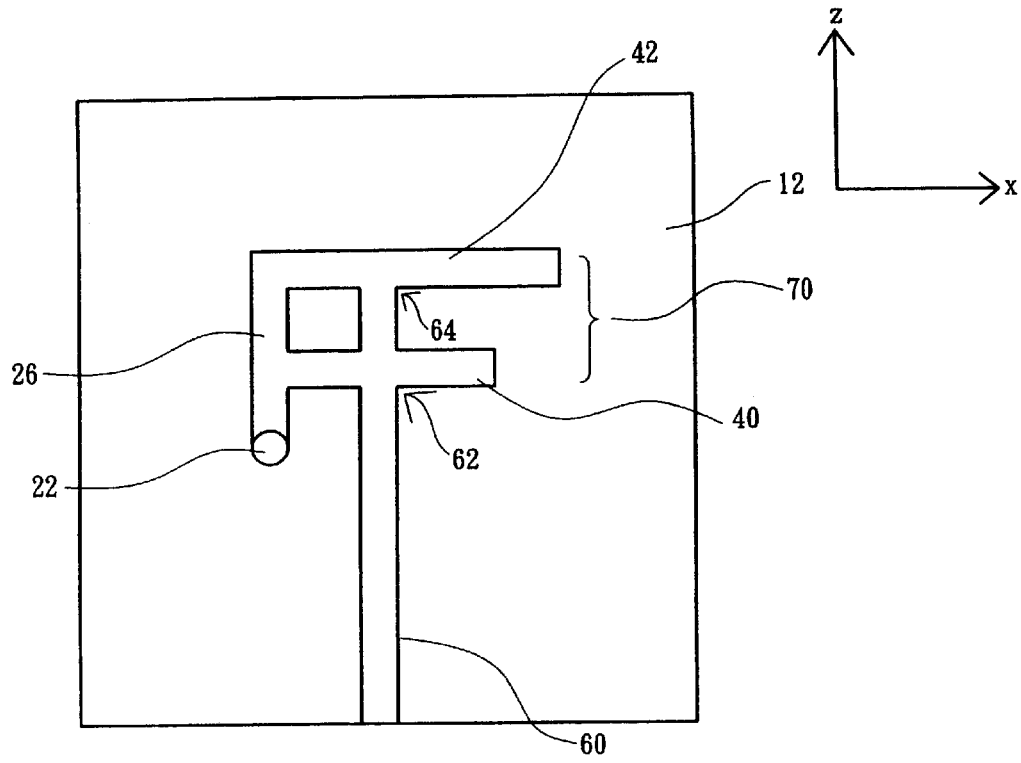
FIG. 1 is a top view of the structure of an embodiment of the dual-band inverted-F antenna of the present invention.
Figure 2:
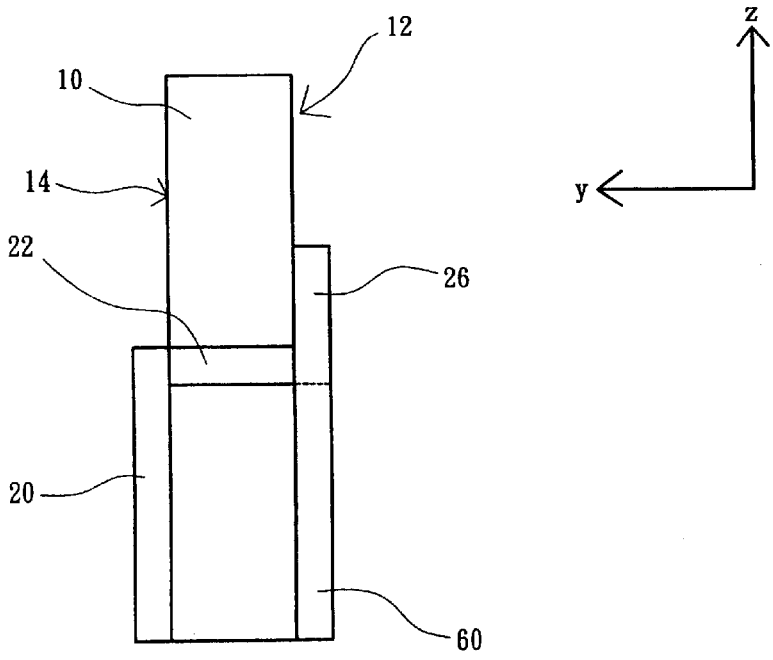
FIG. 2 is a side view along the x direction according to FIG. 1.

Referring to FIG. 1 and FIG. 2, FIG. 1 shows a top view of the structure of an embodiment of the dual-band inverted-F antenna of the present invention, and FIG. 2 shows a side view along the x direction according to FIG. 1. As shown in FIG. 1, a metal line 40, a metal line 42, a feeding metal line 60 providing signals to the metal line 40 and the metal line 42 through a feeding point 62 and a feeding point 64, and a connecting line 26 used to connect the metal line 40 and the metal line 42 to a shorting pin 22 shown in FIG. 2 are printed on the first surface 12 of a substrate 10. A shorting pin 22 shown in FIG. 2 is located in the substrate 10, and is used to connect the metal line 40 and the metal line 42 to the ground plane 20 on the second surface 14 of the substrate 10. Further, the connecting line 26 and the shorting pin 22 are made of metal line.

As shown in FIG. 1, a stacked structure comprising the metal line 40 and the metal line 42 is the major radiating part of the dual-band inverted-F antenna of the present invention, and the metal line 40 and the metal line 42 are connected to the feeding metal line 60, wherein the connecting location thereof is not limited. In FIG. 1, the feeding point 62 and feeding point 64 through which the feeding metal line 60 is connected to the metal line 40 and metal line 42 are located respectively at about the middle points of the metal line 40 and the metal line 42.

The dual-band inverted-F antenna of the present invention can be operated in different frequency bands by using the same feeding metal line, wherein the high frequency operation is controlled by the metal line 40 shown in FIG. 1, and the low frequency operation is controlled by the metal line 42 shown in FIG. 1.

Figure 3:
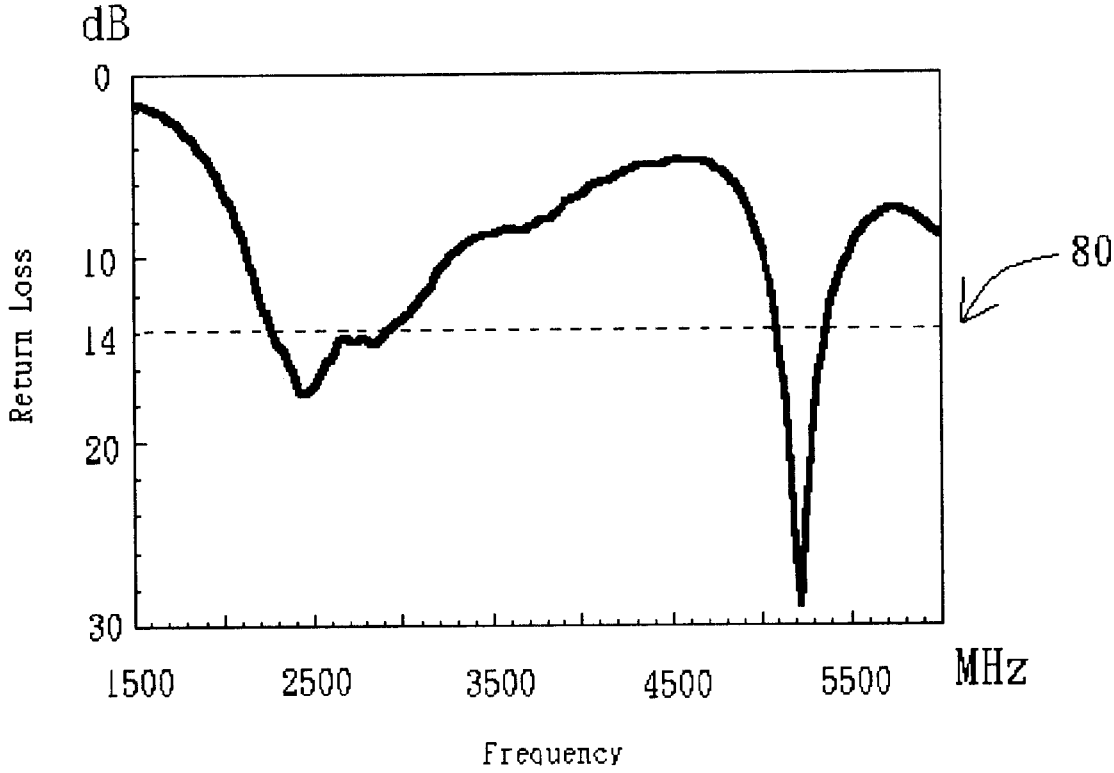
FIG. 3 is a diagram showing measured return loss of the embodiment of the present invention according to FIG. 1.

Through different designs of length, width and shape of the metal line 40 and the metal line 42, the frequency ratio demanded can be achieved easily. Through many different studies, the embodiment of the present invention shown in FIG. 1 can be operated in two separate bands (about 2450 MHz and about 5250 MHz). Referring to FIG. 3, FIG. 3 is a diagram showing measured return loss of the embodiment of the present invention according to FIG. 1. As shown in FIG. 3, the return loss that indicated by the dotted line 80 is about 14 dB, wherein the dotted line 80 is a return-loss reference of the embodiment of the present invention shown in FIG. 1. From FIG. 3, when the embodiment of the present invention shown in FIG. 1 is operated in a range from about 2380 MHz to about 2500 MHz, the return loss is better than 14 dB, and the return loss reaches about 18 dB when the embodiment of the present invention shown in FIG. 1 is operated at about 2500 MHz. When the embodiment of the present invention shown in FIG. 1 is operated in a range from about 5100 MHz to about 5400 MHz, the return loss is also better than 14 dB, and the return loss reaches about 29 dB when the embodiment of the present invention shown in FIG. 1 is operated at about 5200 MHz. Therefore, good impedance matching can be obtained whether the embodiment of the present invention shown in FIG. 1 is operated in the low frequency band (from about 2380 MHz to about 2500 MHz) or in the high frequency band (from about 5100 MHz to about 5400 MHz).

Figure 4:
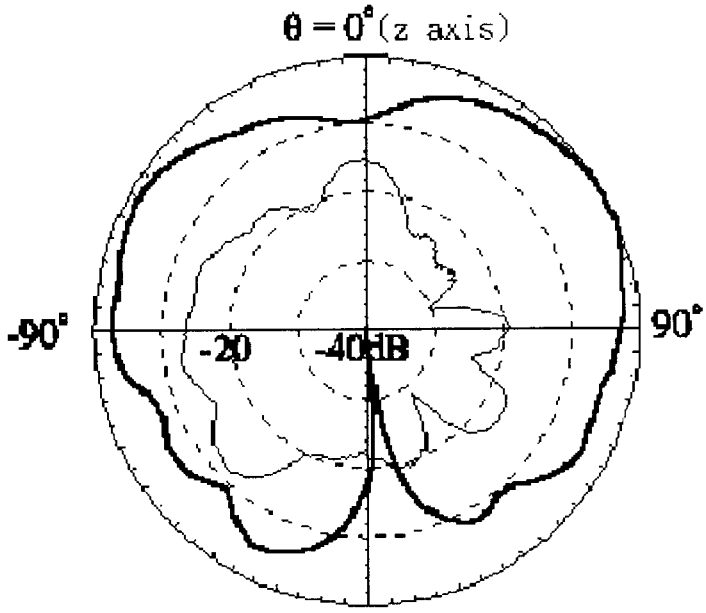
FIG. 4 is a diagram showing measured radiation pattern in x-z plane when the embodiment of the present invention shown in FIG. 1 is operated at 2450 MHz.
Figure 5:
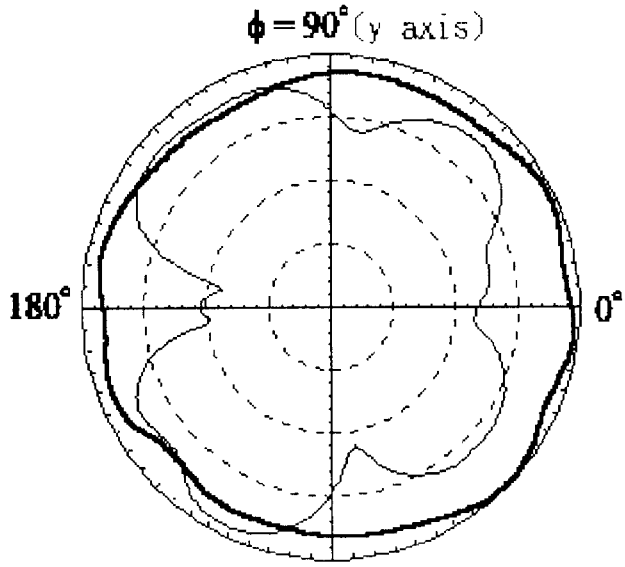
FIG. 5 is a diagram showing measured radiation pattern in x-y plane when the embodiment of the present invention shown in FIG. 1 is operated at 2450 MHz.
Figure 6:
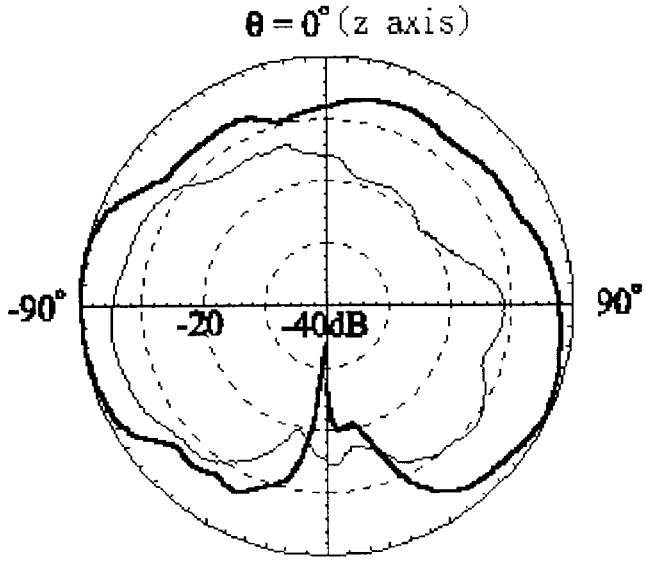
FIG. 6 is a diagram showing measured radiation pattern in y-z plane when the embodiment of the present invention shown in FIG. 1 is operated at 2450 MHz.

When the embodiment of the present invention shown in FIG. 1 is operated in the low frequency band, the signal of low frequency is provided by the feeding metal line 60 to the metal line 42 through the feeding point 64, and the measured radiation patterns in principal planes are shown in FIG. 4 to FIG. 6. FIG. 4 is a diagram showing measured radiation pattern in x-z plane when the embodiment of the present invention shown in FIG. 1 is operated at 2450 MHz. FIG. 5 is a diagram showing measured radiation pattern in x-y plane when the embodiment of the present invention shown in FIG. 1 is operated at 2450 MHz. FIG. 6 is a diagram showing measured radiation pattern in y-z plane when the embodiment of the present invention shown in FIG. 1 is operated at 2450 MHz. In FIG. 4, FIG. 5 and FIG. 6, the variations of the component of electrical field in θ direction is indicated by a thick black line, and that in ϕ direction is indicated by a thin black line. As shown in FIG. 5, the measured radiation pattern in x-y plane is close to omnidirectional, so that good azimuthal coverage can be provided.

Figure 10:
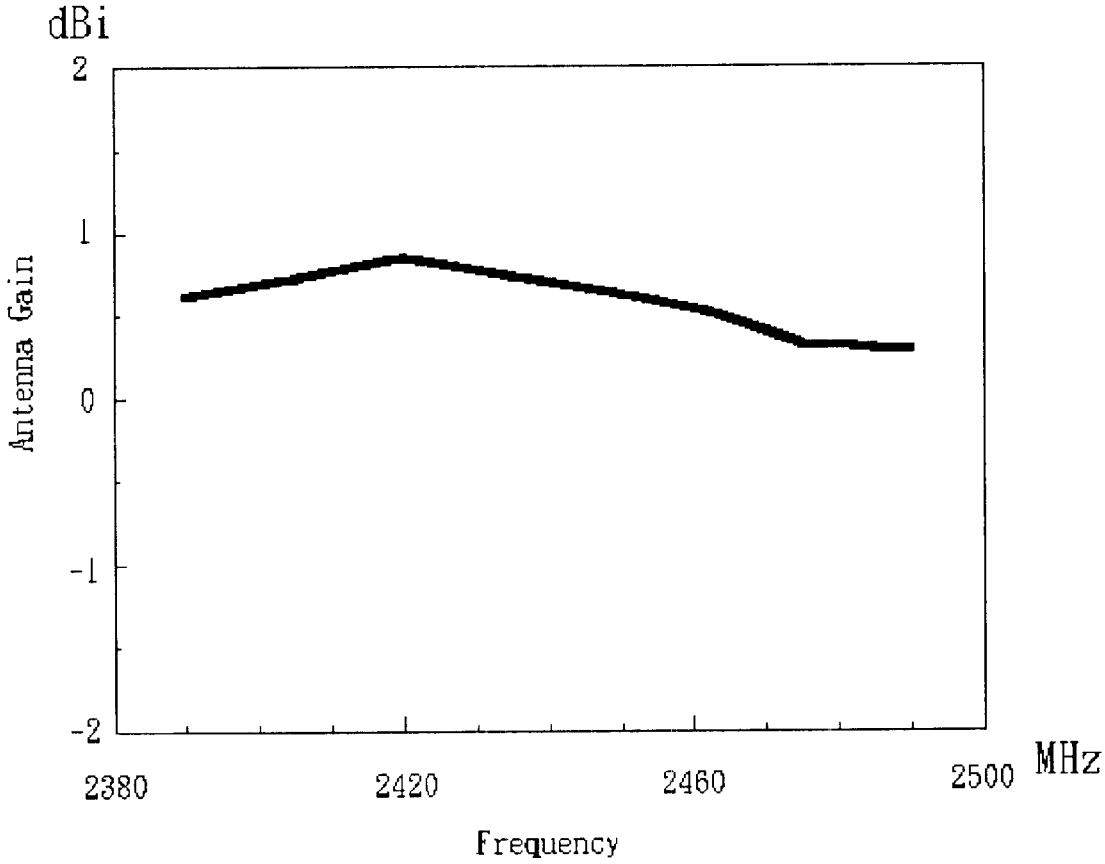
FIG. 10 is a diagram showing measured antenna gain of an embodiment of the present invention operated in a range from 2380 MHz to 2500 MHz according to FIG. 1.

Moreover, referring to FIG. 10, FIG. 10 is a diagram showing measured antenna gain of an embodiment of the present invention that is operated in a range from about 2380 MHz to about 2500 MHz according to FIG. 1. The antenna gain of an embodiment of the present invention shown in FIG. 1 that is operated in a range from about 2380 MHz to about 2500 MHz is from about 0 dBi to about 1 dBi.

Figure 7:
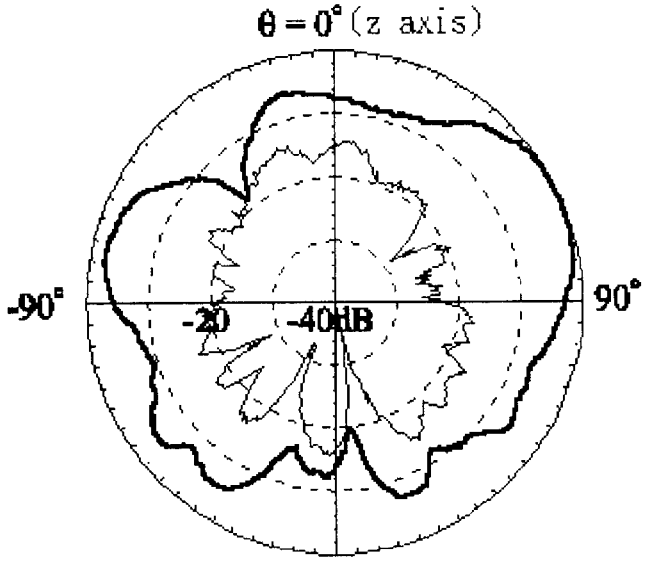
FIG. 7 is a diagram showing measured radiation pattern in x-z plane when the embodiment of the present invention shown in FIG. 1 is operated at 5250 MHz.
Figure 8:
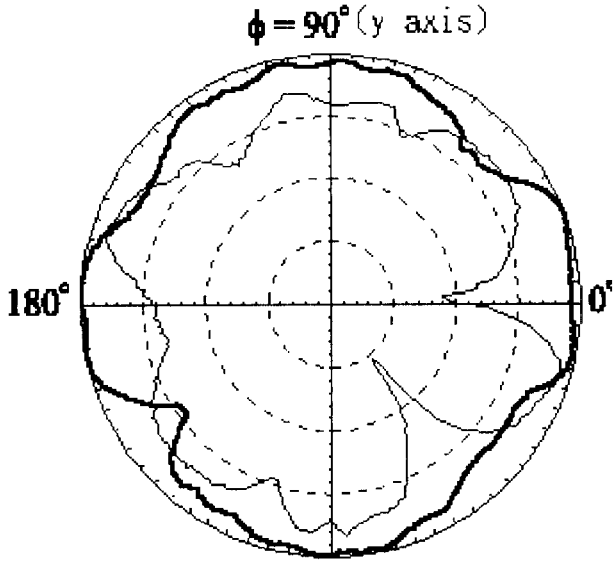
FIG. 8 is a diagram showing measured radiation pattern in x-y plane when the embodiment of the present invention shown in FIG. 1 is operated at 5250 MHz.
Figure 9:
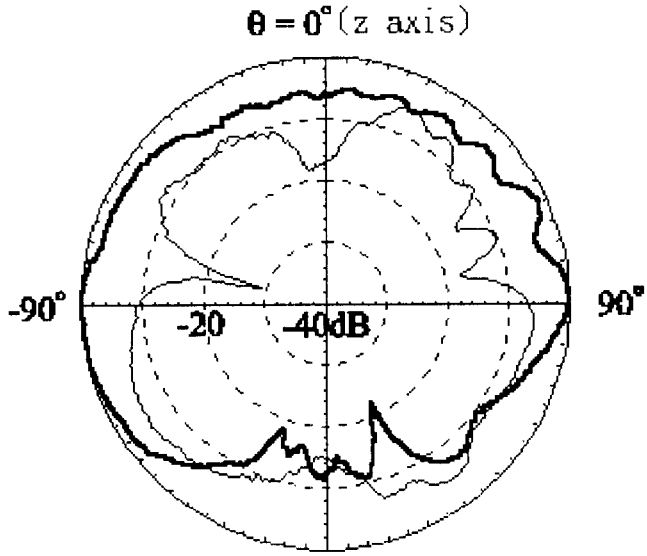
FIG. 9 is a diagram showing measured radiation pattern in y-z plane when the embodiment of the present invention shown in FIG. 1 is operated at 5250 MHz.

When the embodiment of the present invention shown in FIG. 1 is operated in the high frequency band, the signal of high frequency is provided by the feeding metal line 60 to the metal line 40 through the feeding point 62, and the measured radiation patterns in principal planes are shown in FIG. 7 to FIG. 9. FIG. 7 is a diagram showing measured radiation pattern in x-z plane when the embodiment of the present invention shown in FIG. 1 is operated at 5250 MHz. FIG. 8 is a diagram showing measured radiation pattern in x-y plane when the embodiment of the present invention shown in FIG. 1 is operated at 5250 MHz. FIG. 9 is a diagram showing measured radiation pattern in y-z plane when the embodiment of the present invention shown in FIG. 1 is operated at 5250 MHz. In FIG. 7, FIG. 8 and FIG. 9, the variations of the component of electrical field in θ direction is indicated by a thick black line, and that in ϕ direction is indicated by a thin black line. As shown in FIG. 7 to FIG. 9, the radiation patterns of the embodiment of the present invention that operated at 5250 MHz are in general similar to (except that there are more ripples in the radiation patterns) those of the embodiment of the present invention that operated at 2450 MHz.

Figure 11:
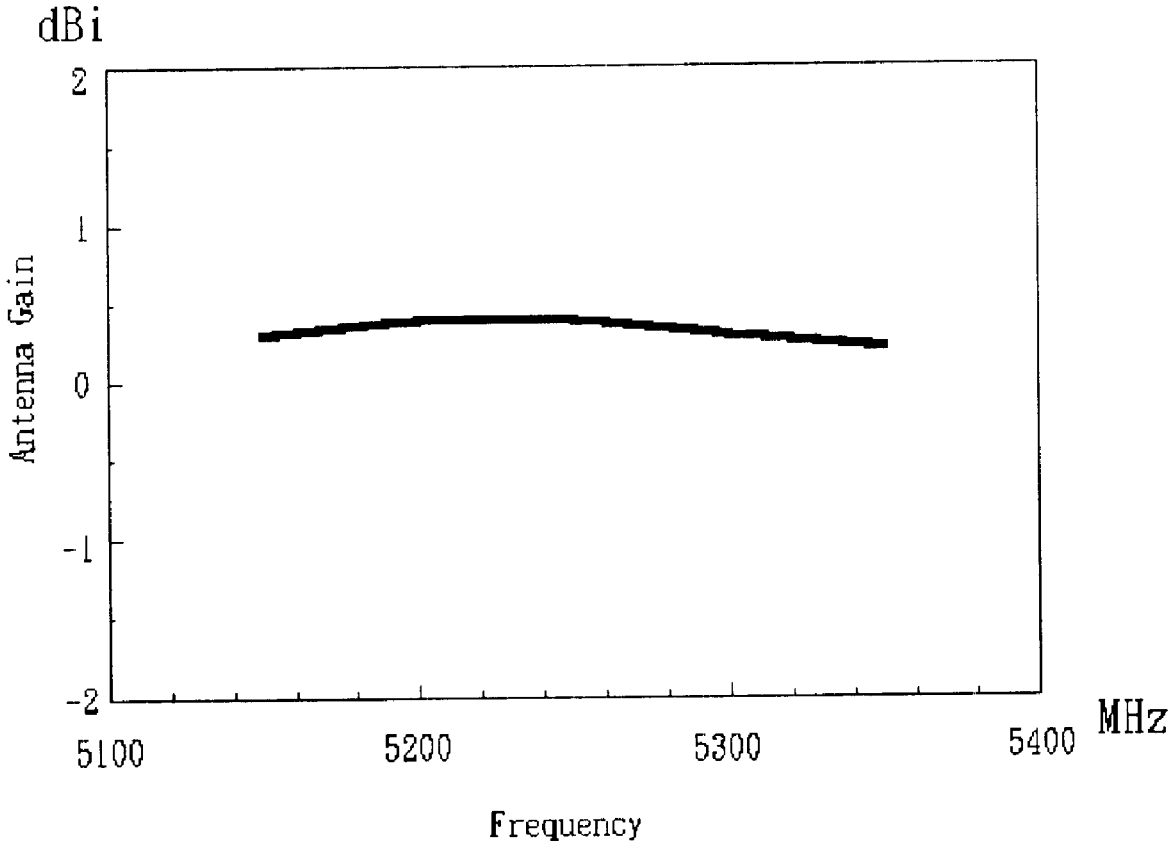
FIG. 11 is a diagram showing measured antenna gain of an embodiment of the present invention operated in a range from 5100 MHz to 5400 MHz according to FIG. 1.
Figure 12:
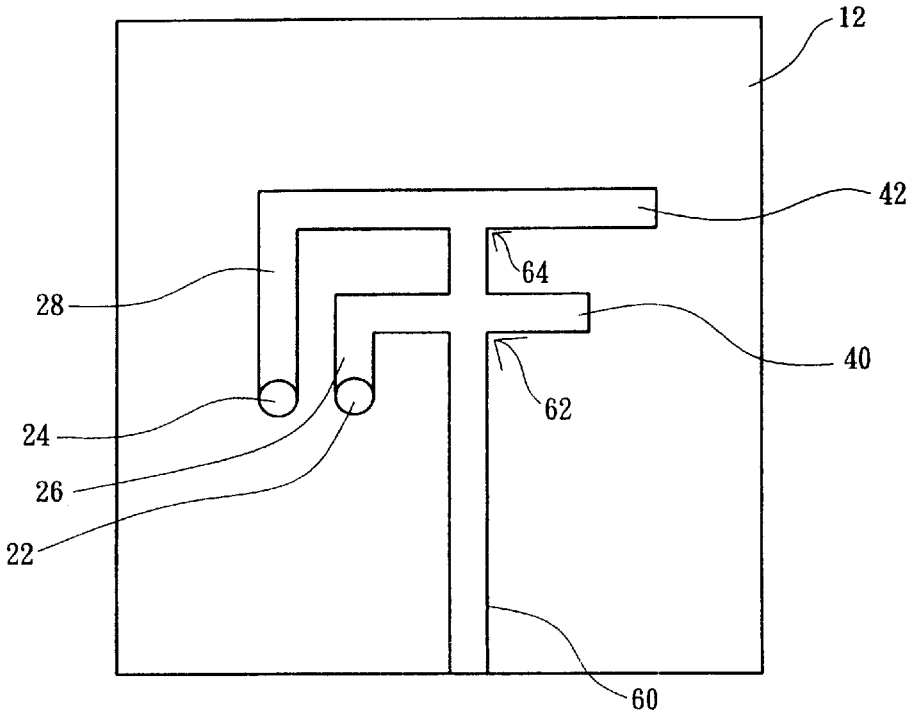
FIG. 12 to FIG. 17 are top views of the structures of dual-band inverted-F antenna of the other embodiments of the present invention.
Figure 13:
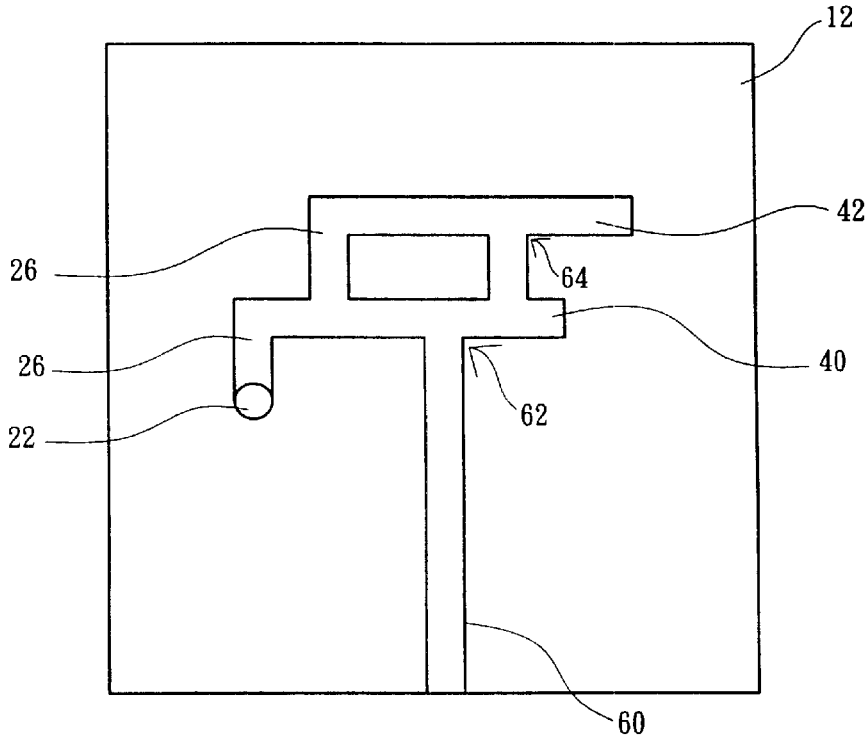
Figure 14:
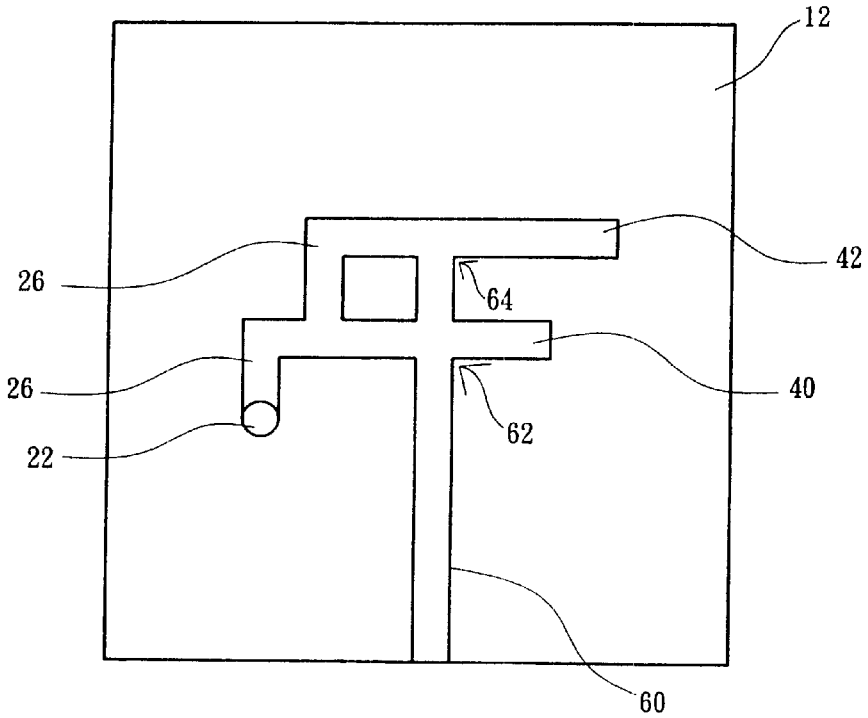
Figure 15:
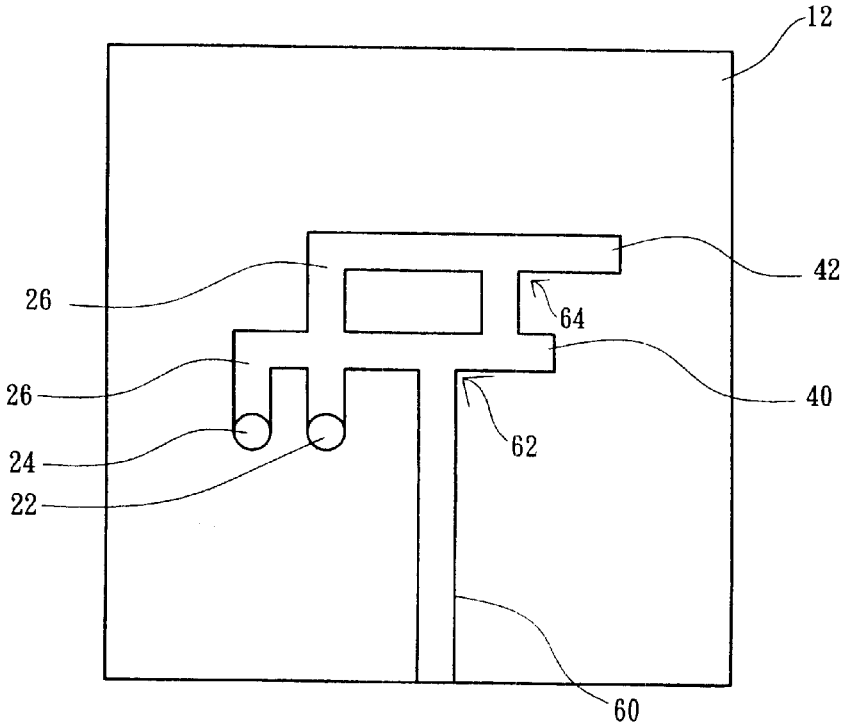
Figure 16:
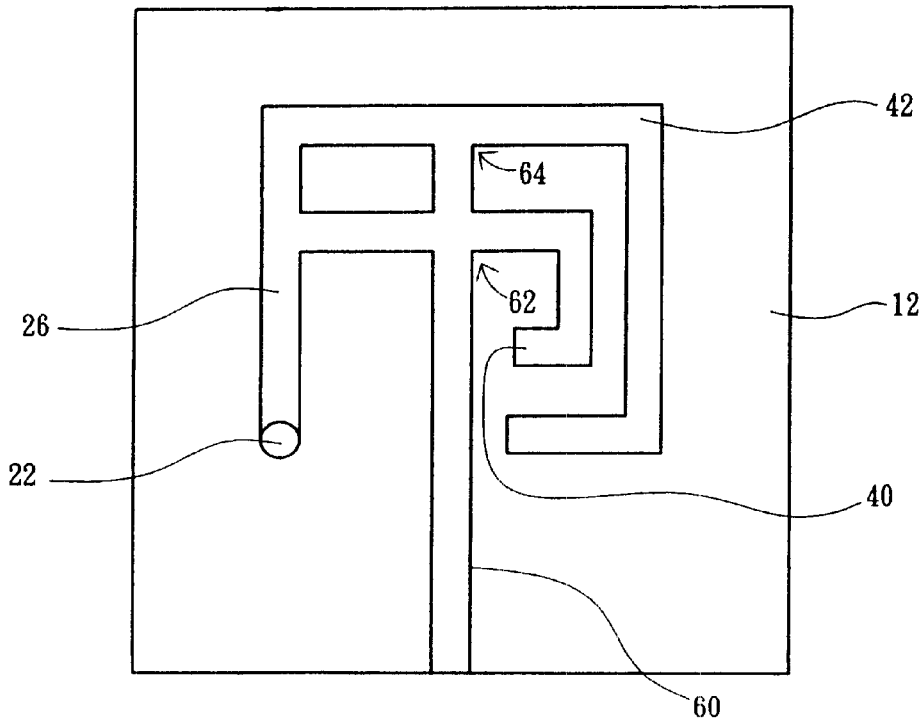
Figure 17:
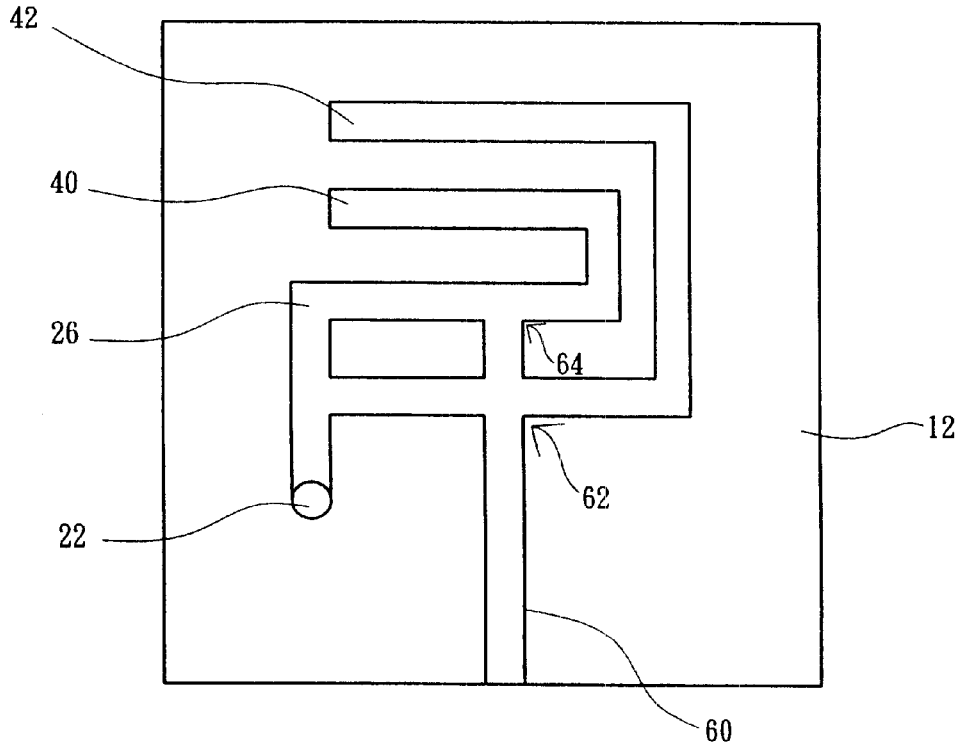

Moreover, referring to FIG. 11, FIG. 11 is a diagram showing measured antenna gain of an embodiment of the present invention that is operated from about 5100 MHz to about 5400 MHz according to FIG. 1. The antenna gain of an embodiment of the present invention shown in FIG. 1 that is operated at from about 5100 MHz to about 5400 MHz is from about 0 dBi to about 0.5 dBi.

Referring to FIG. 12 to FIG. 17, they are top views of the structures of dual-band inverted-F antenna of the other embodiments of the present invention, wherein the metal line 40 and the metal line 42 can be in the same shape and width or not. For example, the metal line 40 and the metal line 42 are in the same shape, and are with the corresponding connecting line 26 and connecting line 28, and are with the shorting pin 22 and shorting pin 24 connected with the ground plane 20, and the signal is fed by the feeding metal line 60 to the metal line 40 and metal line 42 through the feeding point 62 and feeding point 64, wherein the connecting line 28 and the shorting pin 24 are made of metal lines. In the embodiment of the present invention from FIG. 13 to FIG. 15, different operating frequencies can be obtained by changing the layout of connecting line 26 and the feeding metal line. In the embodiment of the present invention from FIG. 16 to FIG. 17, different operating frequencies can be obtained by changing the layout of the metal line 40 and the metal line 42.

The advantage of the present invention is to provide a dual-band inverted-F antenna. More particularly, the present invention relates to an inverted-F printed antenna that can be operated in two separate bands. The dual-band inverted-F antenna of the present invention can be operated in different bands by changing the length, width and shape of the radiating metal lines. Moreover, the demands of bandwidth can be satisfied within the frequency band required. Therefore, the dual-band inverted-F antenna of the present invention has better properties, and in addition, can be manufactured easily on a microwave substrate, so that the cost is lower and the implementation is easily achieved.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structures.

What is claimed is:

1. A dual-band inverted-F antenna, comprising:

a substrate, which consists of a first surface and a second surface, wherein the first surface is located on one side of the substrate and the second surface is located on the other side of the substrate;

a ground plane, which is located on the second surface of the substrate;

a first radiating metal line, which is located on the first surface of the substrate and has a first shape and a first width;

a second radiating metal line, which is located on the first surface of the substrate and has a second shape and a second width;

a feeding metal line, which is located on the first surface of the substrate and is connected to a position of the first radiating metal line and a position of the second radiating metal line;

a connecting line, which is located on the first surface of the substrate and is used to connect with one end of the first radiating metal line and one end of the second radiating metal line at the same time; and a shorting pin, which is located in the substrate and one end of the shorting pin is connected with the ground plane, and the other end of the shorting pin is connected with the connecting line.

2. The dual-band inverted-F antenna of claim 1, wherein the connecting line is a metal line.

3. The dual-band inverted-F antenna of claim 1, wherein the shorting pin is a shorting metal pin.

4. The dual-band inverted-F antenna of claim 1, wherein the first shape of the first radiating metal line is the same as the second shape of the second radiating metal line.

5. The dual-band inverted-F antenna of claim 1, wherein the first width of the first radiating metal line is the same as the second width of the second radiating metal line.

6. The dual-band inverted-F antenna of claim 1, wherein the first width of the first radiating metal line is different from the second width of the second radiating metal line.

7. A dual-band inverted-F antenna, comprising:

a substrate, which consists of a first surface and a second surface, wherein the first surface is located on one side of the substrate and the second surface is located on the other side of the substrate;

a ground plane, which is located on the second surface of the substrate;

a first radiating metal line, which is located on the first surface of the substrate, and has a first shape and a first width;

a second radiating metal line, which is located on the first surface of the substrate and has a second shape and a second width;

a feeding metal line, which is located on the first surface of the substrate and is connected to a position of the first radiating metal line and a position of the second radiating metal line;

a first connecting line, which is located on the first surface of the substrate and is used to connect with one end of the first radiating metal line;

a second connecting line, which is located on the first surface of the substrate and is used to connect with one end of the second radiating metal line;

a first shorting pin, which is located in the substrate, and one end of the first shorting pin is connected with the ground plane and the other end of the first shorting pin is connected with the first connecting line; and a second shorting pin, which is located in the substrate, and one end of the second shorting pin is connected with the ground plane and the other end of the second shorting pin is connected with the second connecting line.

8. The dual-band inverted-F antenna of claim 7, wherein the first connecting line is a metal line.

9. The dual-band inverted-F antenna of claim 7, wherein the second connecting line is a metal line.

10. The dual-band inverted-F antenna of claim 7, wherein the first shorting pin is a first shorting metal pin.

11. The dual-band inverted-F antenna of claim 7, wherein the second shorting pin is a second shorting metal pin.

12. The dual-band inverted-F antenna of claim 7, wherein the first shape of the first radiating metal line is the same as the second shape of the second radiating metal line.

13. The dual-band inverted-F antenna of claim 7, wherein the first width of the first radiating metal line is the same as the second width of the second radiating metal line.

14. The dual-band inverted-F antenna of claim 7, wherein the first width of the first radiating metal line is different from the second width of the second radiating metal line.

* * * * *